US005799632A

United States Patent [19]

Bennett

[11] Patent Number: 5,799,632

[45] Date of Patent: Sep. 1, 1998

[54] HEAT EXCHANGER FOR A HYDROCARBON FUELLED MOTOR VEHICLE

[76] Inventor: Easton Bennett, P.O. Box 72036, Ottewell P.O., Edmonton, Alberta, Canada, T6B 3A7

[21] Appl. No.: 784,071

[22] Filed: Jan. 17, 1997

[30] Foreign Application Priority Data

Sep. 9, 1996 [CA] Canada ..... 2185076

[51] Int. Cl.[6] ..... F02N 17/02

[52] U.S. Cl. ..... 123/142.5 R; 60/320

[58] Field of Search ..... 123/142.5 R; 60/320

[56] References Cited

U.S. PATENT DOCUMENTS

| | | | |
|---|---|---|---|
| 1,168,623 | 1/1916 | Furber | 123/142.5 R |
| 1,231,208 | 6/1917 | Semmler | 123/142.5 R |
| 1,884,538 | 10/1932 | Blake | 123/142.5 R |
| 2,919,540 | 1/1960 | Percival | 60/320 |
| 3,158,192 | 11/1964 | Mizer | 123/142.5 R |
| 3,691,772 | 9/1972 | Cross | 60/320 |
| 4,272,958 | 6/1981 | Waltrip | 60/320 |
| 4,391,235 | 7/1983 | Majkrzak | 123/142.5 R |
| 4,424,775 | 1/1984 | Mayfield, Jr. et al. | 123/142.5 R |
| 4,537,349 | 8/1985 | Stolz | 123/142.5 R |
| 4,611,466 | 9/1986 | Keedy | 123/142.5 R |
| 5,005,542 | 4/1991 | Rissanen | 123/142.5 R |
| 5,551,384 | 9/1996 | Hollis | 123/142.5 R |

*Primary Examiner*—Erick R. Solis
*Attorney, Agent, or Firm*—Anthony R. Lambert

[57] ABSTRACT

A heat exchanger of a hydrocarbon fuelled motor vehicle includes a tubular body having a first end, a second end, and fluid impervious sidewalls formed out of a single length of conduit wound in a spiral coil. Connections are provided at each of the first end and the second end of the tubular body for coupling the tubular body with an exhaust pipe.

5 Claims, 2 Drawing Sheets

HEAT EXCHANGER FOR A HYDROCARBON FUELLED MOTOR VEHICLE

FIELD OF THE INVENTION

The present invention relates to a heat exchanger for a hydrocarbon fuelled motor vehicle.

BACKGROUND OF THE INVENTION

Heat is generated when a hydrocarbon fuel is burned in an engine. This heat is vented to atmosphere, along with other products of combustion, through exhaust pipes. German Patent 28 29 454 which issued to Klockner-Humbolt-Deutz in 1983, discloses a heat exchanger which is adapted to fit around an exhaust pipe. The heat exchanger works in conjunction with a tank supplying water for a car heater. Controls are provides to ensure that the water in the tank neither freezes nor boils. When the temperature approaches freezing, the controls divert the water through the heat exchanger for heating. U.S. Pat. No. 4,391,235 which issued to Majkrzak in 1983 discloses an alternative configuration for transferring heat from hot exhaust gases to water based coolant. In the Majkrzak reference only a portion of the coolant from the engine is diverted in order to avoid any substantial disruption of normal coolant flow.

The heat exchangers disclosed in the German patent and the Majkrzak reference are complex and cannot be readily be installed in most modern motor vehicles due to space limitations.

SUMMARY OF THE INVENTION

What is required is a heat exchanger for a hydrocarbon fuelled motor vehicle that can be installed on modern automobiles notwithstanding space limitations.

According to one aspect of the present invention there is provided a heat exchanger for a hydrocarbon fuelled motor vehicle. The heat exchanger includes a tubular body having a first end, a second end, and fluid impervious sidewalls formed out of a single length of conduit wound in a spiral coil. Means is provided at each of the first end and the second end of the tubular body for coupling the tubular body with an exhaust pipe.

The heat exchanger, as described above, allows heat from exhaust gases to be transferred to fluids passing through the heat exchange coil for use elsewhere on the vehicle where heat is required.

According to another aspect of the present invention there is provided the heat exchanger as described above, in combination with an engine, an hydraulic system, an exhaust pipe and a closed loop fluid circulation conduit. The closed loop circulation conduit circulates hydraulic fluid from the hydraulic system through the heat exchanger coil and then back into the hydraulic system.

According to another aspect of the present invention, there is provided a combination which includes a heater core.

The combination, with a heater core, makes use of the transfer of heat via the heat exchange coil to enhance the operation of the vehicle's heater. The heater of a motor vehicle does not operate properly in cold weather until the engine of the motor vehicle has had sufficient time to warm up. This combination reduces the time required to get the heater fully operational.

Although beneficial results may be obtained through the use of either of the combinations, as described above, once the motor vehicle warms up there can be excessive heat. It is, therefore, preferred that the closed loop fluid circulation conduit include a bypass conduit and valves to control the relative flow of fluids through the bypass conduit and the heat exchange coil.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
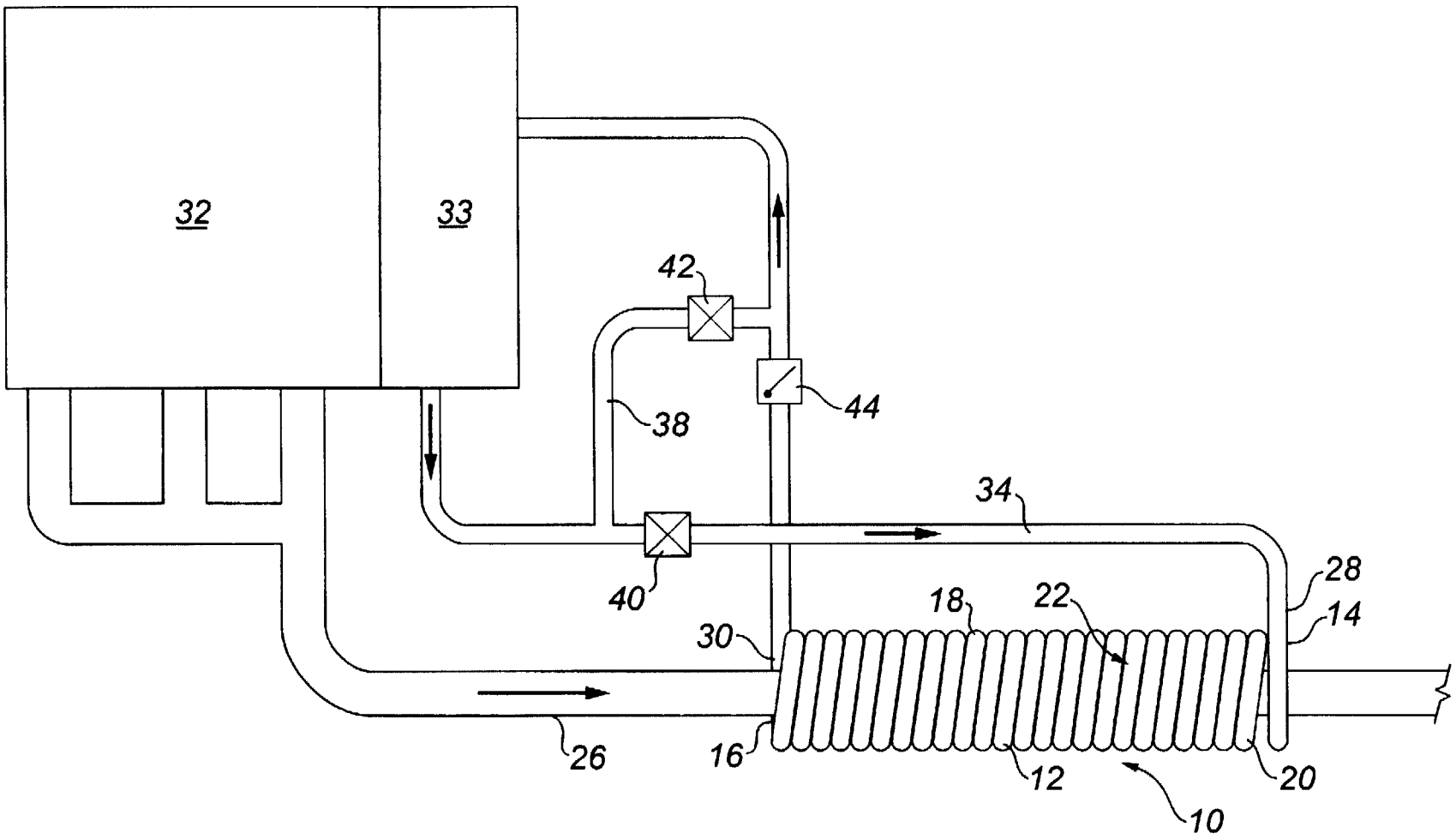
FIG. 1 is a schematic representation of a heat exchanger for a hydrocarbon fuelled motor vehicle constructed in accordance with the teachings of the present invention to heat hydraulic fluid in combination with an engine and an exhaust pipe.

The preferred embodiment, a heat exchanger for a hydrocarbon fuelled motor vehicle generally identified by reference numeral 10, will now be described with reference to FIGS. 1 and 2.

Figure 2:
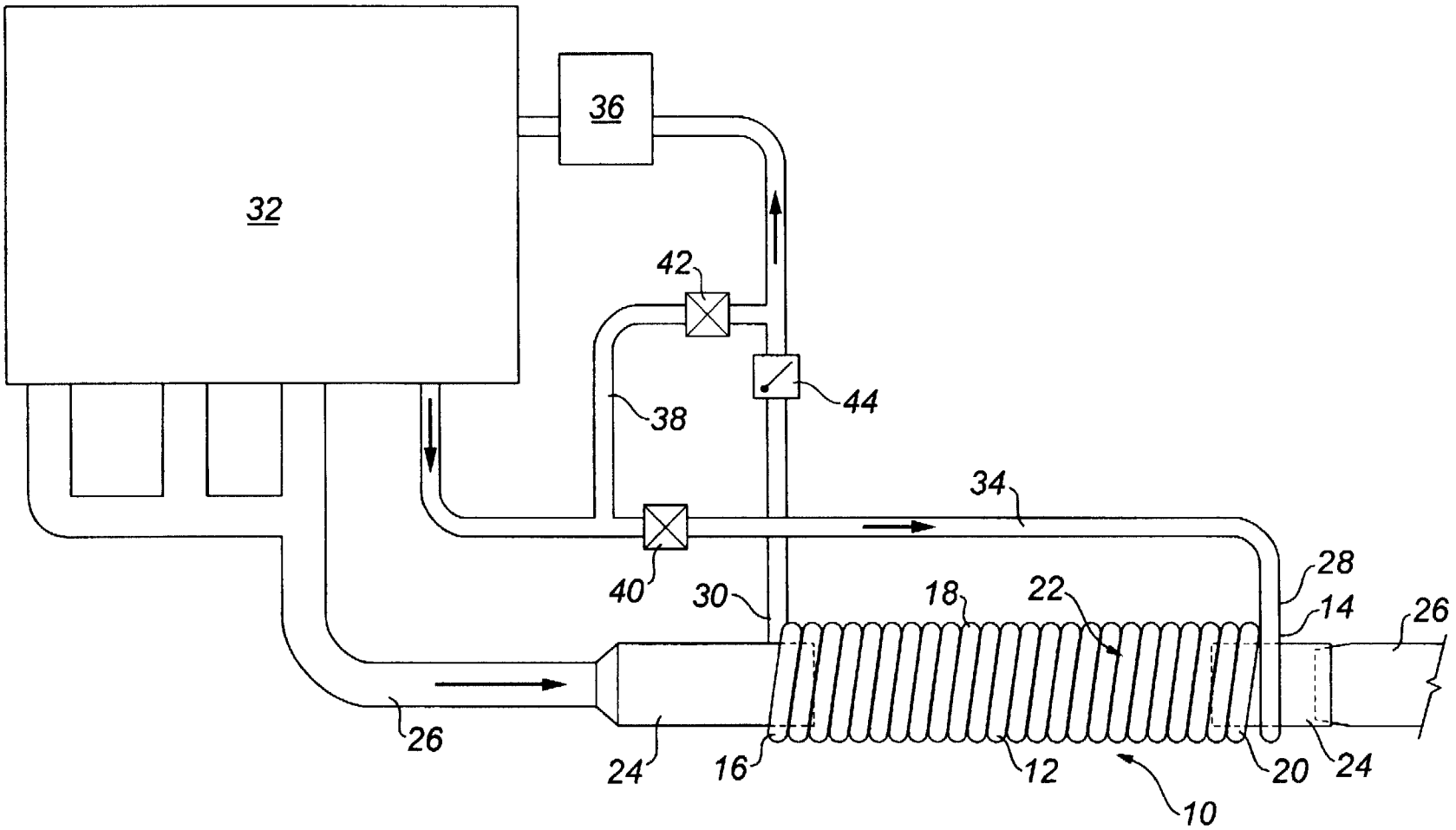
FIG. 2 is a schematic representation of a heat exchanger for a hydrocarbon fuelled motor vehicle constructed in accordance with the teachings of the present invention to heat engine coolant in combination with an engine, a heater coil and an exhaust pipe.

Referring to FIGS. 1 and 2, heat exchanger 10 includes includes a tubular body 12 having a first end 14, a second end 16 and fluid impervious sidewalls 18 formed out of a single length of conduit 20 wound in a spiral heat exchange coil 22. Connections 24 are provided at each of first end 14 and second end 16 of tubular body 12 for coupling tubular body 12 with an exhaust pipe 26. Spiral coil 22 has a first end 28 and 30.

Referring to FIG. 1, heat exchanger 10 has been combined with an engine 32 and an hydraulic system 33 in order to heat hydraulic fluid. First end 28 and second end 30 of coil 22 are connected to a fluid circulation conduit 34. Fluid circulation conduit 34 is a closed loop fluid circulation conduit which enables fluid, in this case hydraulic fluid, to be circulated from hydraulic system 33 through heat exchange coil 22 and then back to hydraulic system 33. When combined, as illustrated, exhaust gases passing through tubular body 12 serve to heat hydraulic fluids passing between first end 28 and second end 30 of heat exchange coil 22. These heated hydraulic fluids are then carried via fluid circulation conduit 34 back to hydraulic system 33. The heating of the hydraulic fluid, as described, enhances cold weather operation of hydraulic system 33.

Referring to FIG. 2, heat exchanger 10 is combined with both engine 32 and a heater core 36 in order to heat coolant. First end 28 and second end 30 of heat exchanger coil 22 are connected to fluid circulation conduit 34, as before. In this case the fluid passes through heater core 36 prior to returning to engine 32. When combined, as illustrated, coolant for heater core 36 is heated, thereby enhancing the operation of the vehicle's heater. This enables the heater is fully operation in cold weather, in less time.

In order to avoid excessive heat, it is preferred that fluid circulation conduit 34 include a bypass conduit 38. Two solenoid valves 40 and 42 are provided on fluid circulation conduit 34. Solenoid valve 40 is positioned downstream of bypass conduit 38 so that all or a portion of the fluids can be diverted into bypass conduit 38 or the flow of fluids through heat exchange coil 22 cut off entirely. Solenoid valve 42 is positioned on bypass conduit 38 so that the flow of fluids through bypass conduit 38 can be reduced or cut off entirely. When solenoid valve 42 is closed and solenoid valve 40 is open, all fluid flowing through fluid circulation conduit 34 passes through heat exchange coil 22. This heats up fluids as rapidly as possible for cold operating conditions. Conversely, when solenoid valve 40 is closed and solenoid valve 42 is open, all fluid flowing through fluid circulation conduit 34 is diverted through bypass conduit 38, bypassing heat exchange coil 22 completely. This mode is used when extra heat is unnecessary or undesirable. When both solenoid valve 40 and 42 are open, it is possible to meter the flow of fluids through the valves to provide a mixed stream with relative portions of the fluid in fluid circulation conduit 34 passing through bypass conduit 38 and heat exchange coil 22. A one way check valve 44 is positioned downstream of second end 30 of heat exchange coil 22. Check valve 44 allows fluid to flow from out of second end 30 of heat exchange coil 22, but prevents a reversal of flow in which fluid enters second end 30.

It will be apparent to one skilled in that art that the heat exchanger will save time and fuel when warming up a motor vehicle prior to use in cold weather. In doing so, the heat exchanger will reduce harmful emissions which result from incomplete combustion. It will also be apparent to one skilled in that art that the head exchanger, as described, can be installed in most motor vehicles notwithstanding severe space limitations. It will finally be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A heat exchanger for a hydrocarbon fuelled motor vehicle, comprising:

a fluid impervious unitary tubular body having a first end, a second end, and fluid impervious sidewalls formed out of a single length of conduit wound in a spiral coil;

means for coupling with an exhaust pipe positioned at each of the first end and the second end of the tubular body.

2. In combination:

a heat exchanger comprising:

a fluid impervious unitary tubular body having a first end, a second end, and fluid impervious sidewalls formed out of a single length of conduit wound in a spiral coil; and means for coupling with an exhaust pipe positioned at each of the first end and the second end of the tubular body;

an hydrocarbon fuelled engine of a vehicle;

a series of axially aligned exhaust pipes connected to the engine, the tubular body being connected to the exhaust pipes, such that exhaust gases from the engine pass through the tubular body;

an hydraulic system; and a closed loop fluid circulation conduit connecting the hydraulic system to the coil, such that hydraulic fluids used are circulated through the coil and back to the hydraulic system.

3. The combination as defined in claim 2, wherein the closed loop fluid circulation conduit includes a bypass conduit with valves controlling the relative flow of fluids through the bypass conduit and the coil.

4. In combination:

a heat exchanger comprising:

a fluid impervious unitary tubular body having a first end, a second end, and fluid impervious sidewalls formed out of a single length of conduit wound in a spiral coil; and means for coupling with an exhaust pipe positioned at each of the first end and the second end of the tubular body;

an hydrocarbon fuelled engine of a vehicle;

a series of axially aligned exhaust pipes connected to the engine, the tubular body being connected to the exhaust pipes, such that exhaust gases from the engine pass through the tubular body;

a heater core; and a closed loop fluid circulation conduit connecting the heater core to the coil, such that coolant used in the heater core is circulated through the coil.

5. The combination as defined in claim 4, wherein the closed loop fluid circulation conduit includes a bypass conduit with valves controlling the relative flow of fluids through the bypass conduit and the coil.

* * * * *